US008664838B2

(12) United States Patent
Yuan et al.

(10) Patent No.: US 8,664,838 B2
(45) Date of Patent: Mar. 4, 2014

(54) ILLUMINATION APPARATUS AND A METHOD OF ASSEMBLING THE ILLUMINATION APPARATUS

(75) Inventors: Chuan Yuan, Shanghai (CN); Xiaoqing Duan, Shanghai (CN); Yan Xiong, Shanghai (CN)

(73) Assignee: Koninklijke Philips N.V., Eindhoven (NL)

( * ) Notice: Subject to any disclaimer, the term of this patent is extended or adjusted under 35 U.S.C. 154(b) by 0 days.

(21) Appl. No.: 13/989,483

(22) PCT Filed: Dec. 8, 2011

(86) PCT No.: PCT/IB2011/055552

§ 371 (c)(1), (2), (4) Date: May 24, 2013

(87) PCT Pub. No.: WO2012/080916

PCT Pub. Date: Jun. 21, 2012

(65) Prior Publication Data

US 2013/0257261 A1 Oct. 3, 2013

(30) Foreign Application Priority Data

Dec. 15, 2010 (CN) ..... PCT/CN2010/079800

(51) Int. Cl.
*H01J 1/02* (2006.01)

(52) U.S. Cl.
USPC ..... 313/46

(58) Field of Classification Search
USPC ..... 313/46, 498
See application file for complete search history.

(56) References Cited

FOREIGN PATENT DOCUMENTS

| | | | |
|---|---|---|---|
| WO | 2009128005 | A1 | 10/2009 |
| WO | 2009138894 | A1 | 11/2009 |
| WO | 2010032169 | A1 | 3/2010 |
| WO | 2010136920 | A1 | 12/2010 |

*Primary Examiner* — Vip Patel
(74) *Attorney, Agent, or Firm* — Kenneth Springer; Mark Beloborodov

(57) ABSTRACT

The invention provides an illumination apparatus (10) and a method of assembling the illumination apparatus. The illumination apparatus comprises a light source (101) having a plurality of LED arrays, wherein at least two of the plurality of LED arrays have different lumen degradations as a function of junction temperature of the respective LED arrays; and a heat dissipation unit (102) configured to be capable of dissipating heat generated by the light source, wherein the heat dissipation unit is mounted on a first surface of the light source in such a way that there is a gap between the first surface and the heat dissipation unit when the light source is not in operation, and the gap is narrowed or can be deemed to disappear when the light source reaches a preset temperature, so that the heat dissipation efficiency of the heat dissipation unit is improved.

13 Claims, 3 Drawing Sheets

ILLUMINATION APPARATUS AND A METHOD OF ASSEMBLING THE ILLUMINATION APPARATUS

FIELD OF THE INVENTION

The present invention relates to the field of lighting, particularly to an illumination apparatus with a short thermal stable time and a method of assembling the illumination apparatus.

BACKGROUND OF THE INVENTION

A phosphor-coated blue LED array, for example a GaN-based LED array, together with a red LED array, for example a AlInGaP LED array, are widely used in efficient LED lamps to generate warm white light in a low CCT range, for example from 2500K to 3000K, for the benefit of high luminous efficacy as well as good CCT and CTI.

The blue LED array and the red LED array have different lumen degradations as a function of junction temperature of the blue LED array and the red LED array, i.e. the red LED array has a much faster lumen degradation than the blue LED array as a function of junction temperature. Therefore, the junction temperature of the blue LED array and the red LED array after the LED lamp is activated will be controlled to a specific temperature, for example 80° C., which is referred to as the thermal stable temperature, to ensure the LED lamp generates the desirable warm white light.

The light generated by the LED lamp after being activated is more reddish initially and then gradually shifts to the desirable warm white color as the junction temperature of the blue LED array and the red LED array increases. Generally, after being activated, the LED lamp will take 20 minutes or even more to achieve the thermal stable temperature, and the user may notice the color shift, for example from reddish to the desired warm white, and feel uncomfortable during this long thermal stable time.

OBJECT AND SUMMARY OF THE INVENTION

In view of the above issues, it would be advantageous to achieve an illumination apparatus with a shorter thermal stable time than the existing illumination apparatus, and it would be desirable to achieve a method of assembling the illumination apparatus.

To better address the above concern, according to an embodiment of the invention, there is provided an illumination apparatus comprising:

- a light source comprising a plurality of LED arrays, wherein at least two of the plurality of LED arrays have different lumen degradations as a function of junction temperature of the respective LED arrays;
- a heat dissipation unit configured to be capable of dissipating heat generated by the light source;

wherein the heat dissipation unit is mounted on a first surface of the light source in such a way that there is a gap between the first surface and the heat dissipation unit when the light source is not in operation, and the gap is narrowed or can be deemed to disappear when the light source reaches a preset temperature, so that the heat dissipation efficiency of the heat dissipation unit is improved.

Advantageously, the illumination apparatus further comprises:

- a thermal deformation material configured to deform so as to make the gap narrow or deemed to disappear when the first surface reaches the preset temperature.

As a gap is set between the first surface of the light source and the heat dissipation unit, the heat dissipation efficiency of the heat dissipation unit for the light source is poor at the beginning of the light emission of the light source and, as a result, the temperature of the light source increases rapidly. When the temperature of the light source reaches a preset value, which is for example slightly lower than the thermal stable temperature of the light source, the gap is narrowed or can be deemed to disappear by virtue of, for example, the thermal deformation material to ensure that the heat dissipation unit has a good thermal interaction with the light source so as to dissipate the heat generated by the light source more effectively. With this configuration, after activation of the light source, the temperature of the light source increases rapidly to the preset temperature, and is then controlled to the thermal stable temperature by the heat dissipation unit; therefore, the thermal stable time of the light source is shortened significantly, for example to approximately 3 minutes, and the user can hardly notice the color shift during this short thermal stable time.

Advantageously, the illumination apparatus further comprises:

- an upper cover mounted on a second surface opposite to the first surface of the light source and configured to at least partly enclose the plurality of LED arrays;

wherein the thermal deformation material is arranged between the upper cover and the second surface, and configured to expand so as to press the light source towards the heat dissipation unit to make the gap narrow or deemed to disappear when the first surface reaches the preset temperature.

Advantageously, the thermal deformation material is arranged between the first surface and the heat dissipation unit to form the gap therebetween when the light source is not in operation, and configured to deform so as to make the gap narrow or deemed to disappear when the first surface reaches the preset temperature.

According to another embodiment of the invention, there is provided a method of assembling an illumination apparatus, wherein the illumination apparatus comprises a light source and a heat sink, wherein the light source comprises a plurality of LED arrays, and at least two of the plurality of LED arrays have different lumen degradations as a function of junction temperature, the method comprising:

- mounting the heat dissipation unit on a first surface of the light source in such a way that there is a gap between the first surface and the heat dissipation unit when the light source is not in operation, and the gap is narrowed or can be deemed to disappear when the first surface reaches a preset temperature, causing the heat dissipation efficiency of the heat dissipation unit to be improved.

BRIEF DESCRIPTION OF THE DRAWINGS

The invention is explained in further detail, and by way of example, with reference to the accompanying drawings, in which.

Throughout the above drawings, like reference numerals will be understood to refer to like, similar or corresponding features or functions.

DETAILED DESCRIPTION

Reference will now be made to embodiments of the invention, one or more examples of which are illustrated in the figures. The embodiments are provided by way of explanation of the invention, and are not meant as a limitation of the invention. For example, features illustrated or described as part of one embodiment may be used with another embodiment to yield a still further embodiment. It is intended that the invention encompass these and other modifications and variations as come within the scope and spirit of the invention.

The illumination apparatus of the invention comprises a light source having a plurality of LED arrays, wherein at least two of the plurality of LED arrays have different lumen degradations as a function of junction temperature of the respective LED arrays. For example, the light source of the invention may comprise a phosphor-coated blue LED array and a red LED array, or comprise a red LED array, a green LED array and a blue LED array.

The illumination apparatus of the invention further comprises a heat dissipation unit configured to be capable of dissipating heat generated by the light source, wherein the heat dissipation unit is mounted on a first surface of the light source in such a way that there is a gap between the first surface and the heat dissipation unit when the light source is not in operation, and the gap is narrowed or can be deemed to disappear when the light source reaches a preset temperature, causing the heat dissipation efficiency of the heat dissipation unit to be improved.

Advantageously, the illumination apparatus of the invention may further comprise a thermal deformation material configured to deform so as to make the gap narrow or deemed to disappear when the light source reaches the preset temperature.

Hereinafter, for illustrative purposes only, the implementation/configuration of the illumination apparatus of the invention will be described in detail by using a phosphor-coated blue LED array together with a red LED array as an illustrative example of the light source. It will be understood that a person of ordinary skill in the art can then fully appreciate the implementation/operation of the illumination apparatus by using a red LED array together with a green LED array and a blue LED array as an example of the light source.

Figure 1:
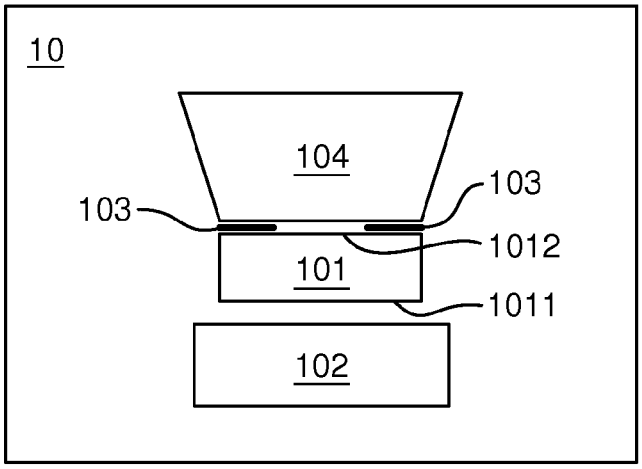
FIG. 1 is a sectional view of an exemplary illumination apparatus 10 according to an embodiment of the invention.

FIG. 1 is a sectional view of an exemplary illumination apparatus 10 according to an embodiment of the invention. The illumination apparatus 10 of FIG. 1 comprises a light source 101, a heat dissipation unit 102, a thermal deformation material 103 and an upper cover 104.

The light source 101 comprises a phosphor-coated blue LED array and a red LED array. The phosphor-coated blue LED array and the red LED array may be packaged onto a carrier substrate, for example a ceramic substrate with one silicone lens encapsulation on said two LED arrays to constitute the light source 101. Alternatively, the phosphor-coated blue LED array and the red LED array may be packaged onto a carrier substrate with silicone lens encapsulations on each individual LED array to constitute the light source 101.

The blue LED array may comprise one or more GaN-based LEDs such as GaN LEDs, GaAlN LEDs, InGaN LEDs, or InAlGaN LEDs for example, or any other LEDs which are suitable to generate blue light. The red LED array may comprise one or more AlInGaP LEDs, or any other LEDs which are suitable to generate red light. The phosphor coated on the blue LED array may be Yttrium Aluminum Garnet (YAG), or Terbium Aluminum Garnet (TAG), for example.

As the red LED array has a much faster lumen degradation than the blue LED array as a function of junction temperature, the junction temperature of the red LED array and the blue LED array, i.e., the temperature of the light source 101, will be controlled to a specific temperature, which is referred to as the thermal stable temperature, of the light source 101, by for example the heat dissipation unit 102 to ensure the light source 101 generates the desirable warm white light.

The heat dissipation unit 102 is mounted on a first surface 1011 of the light source 101 by means of for example a screw, which is not screwed in completely, or a spring, such that a gap is formed between the first surface 1011 of the light source 101 and the heat dissipation unit 102 when the light source 101 is not in operation. The heat dissipation unit 102 may comprise a heat sink alternatively provided with a cooling fan or any other manner of dissipating the heat generated by light source 101 so as to control the temperature of the light source 101 to the thermal stable temperature.

Advantageously, the illumination apparatus 10 may further comprise a PCB board (not shown in FIG. 1). The phosphor-coated blue LED array and the red LED array are mounted on a first surface of the PCB board to be electrically coupled to a power supply through the PCB board. The heat dissipation unit 102 in this case is mounted on a second surface opposite to the first surface of the PCB board.

The upper cover 104 is mounted on a second surface 1012, i.e., a light-emitting surface, opposite to the first surface 1011 of the light source 101 to at least partly enclose the phosphor-coated blue LED array and the red LED array. The upper cover 104 may take on any configuration, but generally includes an optical component to distribute the light generated by the light source 101. The optical component may be a light gathering component, for example a LED lens, which is used for gathering the light generated by the light source 101, but other optical components are also possible, such as a light diffusing component for example.

The thermal deformation material 103, which is arranged between the upper cover 104 and the second surface 1012 of the light source 101, may be a bimetal, a shape memory alloy, or a silicon rubber spacer, for example.

As the thermal deformation material 103 deforms when the light source 101 is in operation and reaches a preset temperature, the upper cover 104 is movably mounted on the second surface 1012 of the light source 101 so as to tolerate the deformation of the thermal deformation material 103.

Hereinafter, for illustrative purposes only, the configuration/implementation of the illumination apparatus 10 of FIG. 1 will be described by using said bimetal as an illustrative example of the thermal deformation material 103.

Figure 2A:
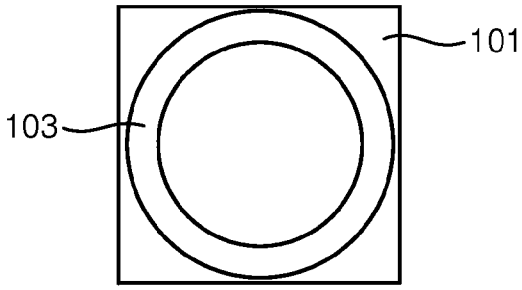
FIG. 2*a* is a top view of an exemplary bimetal 103 used in the illumination apparatus 10 of FIG. 1.

FIG. 2*a* is a top view of an exemplary bimetal 103 used in the illumination apparatus 10 of FIG. 1. The low expansion layer of the bimetal 103 may be an Ni—Fe alloy for example, and the high expansion layer of the bimetal 103 may be an Ni—Mn—Cu alloy, or an Fe—Ni—Cr alloy, for example.

Figure 2B:
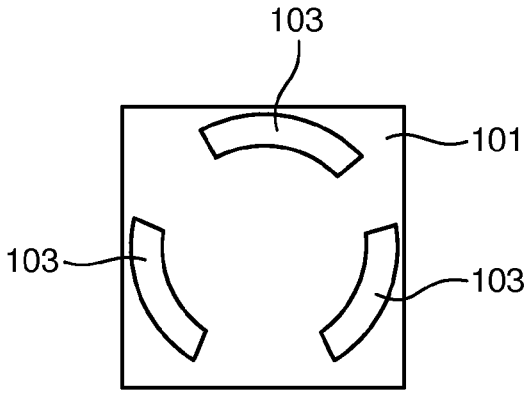
FIG. 2*b* is a top view of another exemplary bimetal 103 used in the illumination apparatus 10 of FIG. 1.

It is to be noted that the bimetal 103 is not limited to the ring shape as shown in FIG. 2*a*, and that any other shape which allows passage of the light generated by the light source 101 is also possible, for example the bimetal 103 may comprise a plurality of bimetal segments respectively placed at different positions between the first surface 1011 of the light source 101 and the heat dissipation unit 102 as shown in FIG. 2*b*.

Figure 3:
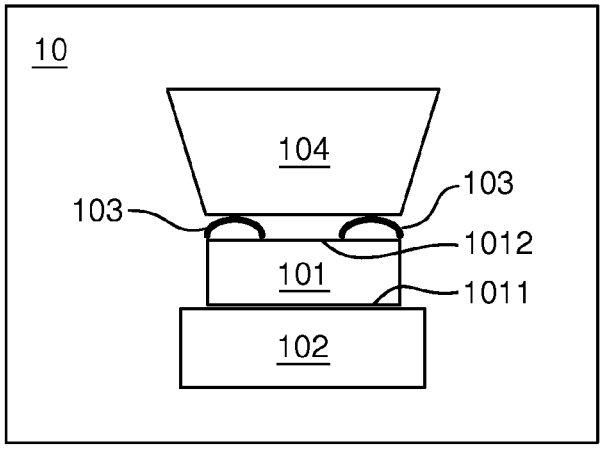
FIG. 3 is a sectional view of the exemplary illumination apparatus 10 of FIG. 1 in operation.

When the light source 101 is not in operation, the gap is formed between the first surface 1011 of the light source 101 and the heat dissipation unit 102 as shown in FIG. 1. After activation of the light source 101, the temperature of the light source 101 begins to increase and the bimetal 103 gradually deforms, i.e., bends in the direction of the high expansion layer. As the heat dissipation unit 102 is kept at a distance from the light source 101 by the gap at the beginning of the light emission of the light source 101, the heat dissipation efficiency of the heat dissipation unit 102 for the light source 101 is poor and thus the temperature of the light source 101 increases rapidly. When the temperature of the light source 101 reaches the preset temperature, the bimetal 103 deforms, thereby pressing the light source 101 onto the heat dissipation unit 102 so that the gap between the first surface 1011 of the light source 101 and the heat dissipation unit 102 is narrowed or can be deemed to disappear, as shown in FIG. 3, as a result of which the heat dissipation unit 102 has good thermal interaction with the light source 101 and accordingly the heat dissipation efficiency of the heat dissipation unit 102 is improved so as to dissipate the heat generated by the light source 101 more effectively to control the light source 101 to the thermal stable temperature.

The preset temperature may be set lower than the thermal stable temperature of the light source 101 so as to ensure that the gap is narrowed or can be deemed to disappear before the light source 101 reaches the thermal stable temperature. The closer the preset temperature is set to the thermal stable temperature of the light source 101, the shorter the thermal stable time needed for the light source 101 is. For example, if the thermal stable temperature of the light source 101 is 80° C., then the preset temperature is preferably set in the range of [60° C., 70° C.].

The gap between the first surface 1011 of the light source 101 and the heat dissipation unit 102 may be set in dependence on the deformation of the bimetal 103 at the preset temperature. Preferably, the size of the gap may be set substantially equal to the size of the deformation of the bimetal 103 at the preset temperature.

To facilitate thermal transfer between the light source 101 and the heat dissipation unit 102 after the gap between the first surface 1011 of the light source 101 and the heat dissipation unit 102 is narrowed or can be deemed to disappear, advantageously the illumination apparatus 10 may further comprise a thermal interface material arranged between the first surface 1011 of the light source 101 and the heat dissipation unit 102. The thermal interface material may be a thermal pad, thermal grease, or a thermal paste, for example.

With the configuration of the illumination apparatus 10 of FIG. 1, the temperature of the light source 101 increases rapidly to the preset temperature after the light source 101 has been activated, and is then controlled to the thermal stable temperature by the heat dissipation unit 102. Therefore, the thermal stable time of the light source 101 is shortened significantly, for example to around 3 minutes, and the user can hardly notice the color shift during this short thermal stable time.

Figure 4:
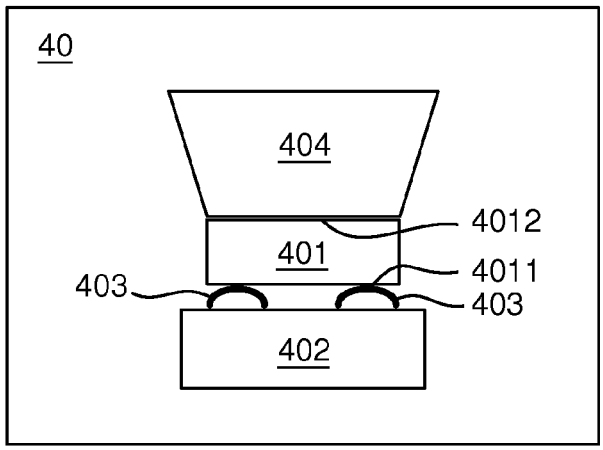
FIG. 4 is a sectional view of an exemplary illumination apparatus 40 according to another embodiment of the invention

FIG. 4 is a sectional view of an exemplary illumination apparatus 40 according to another embodiment of the invention. The illumination apparatus 40 of FIG. 4 comprises a light source 401, a heat dissipation unit 402, a thermal deformation material 403 and an upper cover 404. The configurations of the light source 401, the heat dissipation unit 402 and the upper cover 404 may be same as those of the corresponding modules of FIG. 1, and will not be described here for the purpose of simplicity.

As shown in FIG. 4, the heat dissipation unit 402 is mounted on a first surface 4011 of the light source 401, and the thermal deformation material 403 is arranged between the first surface 4011 of the light source 401 and the heat dissipation unit 402 to form a gap therebetween when the light source 401 is not in operation. The thermal deformation material 403 may be a shape memory alloy or a bimetal, for example.

The thermal deformation material 403 is shaped at ambient temperature so that the gap is formed between the first surface 4011 of the light source 401 and the heat dissipation unit 402 when the light source 401 is not in operation. When the light source 401 is in operation and reaches a preset temperature, the thermal deformation material 403 returns to its pre-deformed shape, for example a substantially plane shape, so that the gap between the first surface 4011 of the light source 401 and the heat dissipation unit 402 is narrowed or can be deemed to disappear.

Figure 5A:
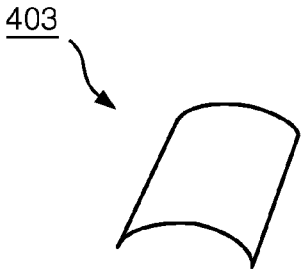
FIG. 5*a* is a schematic view of an exemplary thermal deformation material 403 used in the illumination apparatus 40 of FIG. 4.
Figure 5B:
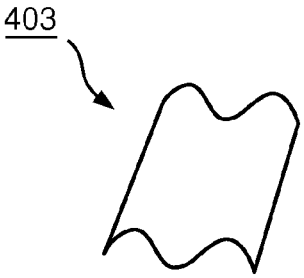
FIG. 5*b* is a schematic view of another exemplary thermal deformation material 403 used in the illumination apparatus 40 of FIG. 4.

To further decrease thermal interaction between the light source 401 and the heat dissipation unit 402 at the beginning of light emission of the light source 401, preferably the thermal deformation material 403 may be shaped such that it has a smaller contact area, for example a point contact or line contact, with the heat dissipation unit 402. For example, the thermal deformation material 403 may be shaped so as to be an arch, as shown in FIG. 5*a*. Alternatively, the thermal deformation material 403 may be shaped so as to be undulating, as shown in FIG. 5*b*.

Hereinafter, for illustrative purposes only, the configuration/implementation of the illumination apparatus 40 of FIG. 4 will be described by using the shape memory alloy as an illustrative example of the thermal deformation material 403.

The shape memory alloy 403 may be an intrinsic two-way shape memory alloy which can remember both its low-temperature shape, for example the shape at ambient temperature, and its high-temperature shape, for example the shape at the preset temperature. Alternatively, the shape memory alloy 403 may be an extrinsic one-way shape memory alloy. The illumination apparatus 40 in this case may further comprise an external force generating unit which is used for shaping the extrinsic one-way shape memory alloy again when the extrinsic one-way shape memory alloy is cooling to ambient temperature.

Figure 6:
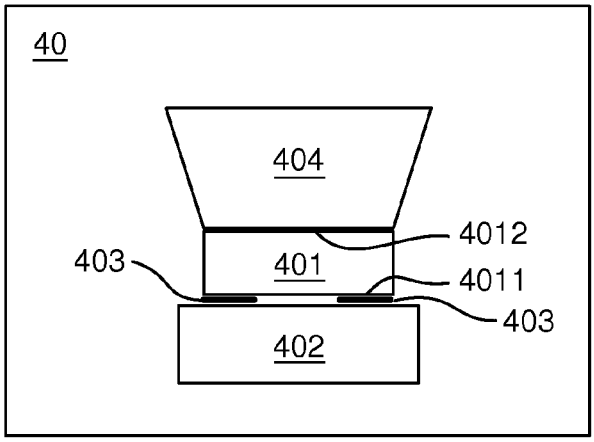
FIG. 6 is a sectional view of the exemplary illumination apparatus 40 of FIG. 4 in operation.

When the light source 401 is not in operation, the gap is formed between the first surface 4011 of the light source 401 and the heat dissipation unit 402 as shown in FIG. 4. After the light source 401 has become operative, the temperature of the light source 401 begins to increase. As the heat dissipation unit 402 is kept at a distance from the light source 401 by the gap at the beginning of the light emission of the light source 401, the heat dissipation efficiency of the heat dissipation unit 402 for the light source 401 is poor, thereby causing the temperature of the light source 401 to increase rapidly. When the temperature of the light source 401 reaches the preset temperature, the shape memory alloy 403 returns to its pre-deformed shape, for example a substantially plane shape, so that the gap between the first surface 4011 of the light source 401 and the heat dissipation unit 402 is narrowed or can be deemed to disappear, as shown in FIG. 6, thereby allowing good thermal interaction of the heat dissipation unit 402 with the light source 401 so as to dissipate the heat generated by the light source 401 more effectively and control the light source 401 to the thermal stable temperature.

The preset temperature may be set lower than the thermal stable temperature of the light source 401 so as to ensure the gap is narrowed or can be deemed to disappear before the light source 401 reaches the thermal stable temperature. The closer the preset temperature is set to the thermal stable temperature of the light source 401, the shorter the thermal stable time needed for the light source 401 is. The shape memory alloy 403 is selected such that its transition temperature is lower than or substantially equal to the preset temperature.

To facilitate thermal transfer between the light source 401 and the heat dissipation unit 402 after the gap between the first surface 4011 of the light source 401 and the heat dissipation unit 402 is narrowed or can be deemed to disappear, advantageously the illumination apparatus 40 may further comprise a thermal interface material arranged between the first surface 4011 of the light source 401 and the heat dissipation unit 402. The configuration/material of the thermal interface material may be same as that of FIG. 1, and will not be described here for the purpose of simplicity.

Advantageously, the illumination apparatus 40 may further comprise an upper cover 404, which is mounted on a second surface 4012, i.e., a light-emitting surface opposite to the first surface 4011 of the light source 401, to at least partly enclose the phosphor-coated blue LED array and the red LED array. The configuration of the upper cover 404 may be the same as that of the upper cover 104 of FIG. 1, and will not be described here for the purpose of simplicity.

Figure 7:
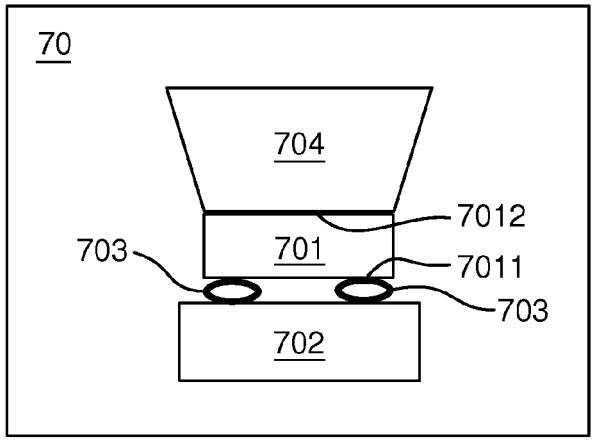
FIG. 7 is a sectional view of an exemplary illumination apparatus 70 according to a further embodiment of the invention.

FIG. 7 is a sectional view of an exemplary illumination apparatus 70 according to a further embodiment of the invention. The illumination apparatus 70 of FIG. 7 comprises a light source 701, a heat dissipation unit 702, a thermal deformation material 703 and an upper cover 704. The configurations of the light source 701, the heat dissipation unit 702 and the upper cover 704 may be same as those of the corresponding modules of FIG. 1 or FIG. 4, and will not be described here for the purpose of simplicity.

As shown in FIG. 7, the heat dissipation unit 702 is mounted on a first surface 7011 of the light source 701, and the thermal deformation material 703 is arranged between the first surface 7011 of the light source 701 and the heat dissipation unit 702 to form a gap therebetween when the light source 701 is not in operation. The thermal deformation material 703 in this embodiment may be a thermal shrinkage material which has a large size at ambient temperature to form the gap between the first surface 7011 of the light source 701 and the heat dissipation unit 702, and which shrinks when the light source 701 is in operation and reaches a preset temperature.

Figure 8:
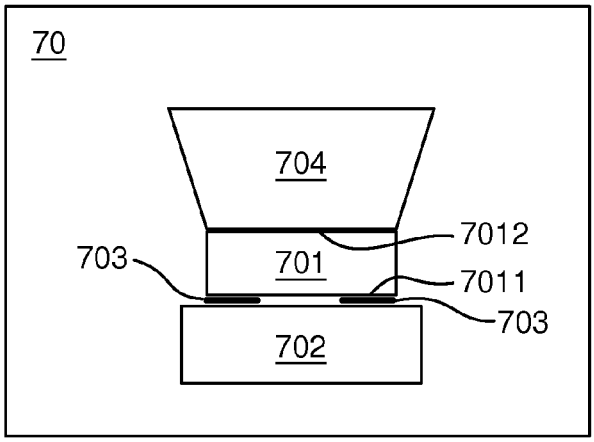
FIG. 8 is a sectional view of the exemplary illumination apparatus 70 of FIG. 7 in operation.

When the light source 701 is not in operation, the gap is formed between the first surface 7011 of the light source 701 and the heat dissipation unit 702 as shown in FIG. 7. After the light source 701 has been activated, the temperature of the light source 701 begins to increase. As the heat dissipation unit 702 is kept at a distance from the light source 701 by the gap at the beginning of the light emission of the light source 701, the heat dissipation efficiency of the heat dissipation unit 702 for the light source 701 is poor, thereby causing the temperature of the light source 701 to increase rapidly. When the temperature of the light source 701 reaches the preset temperature, the thermal deformation material shrinks so that the gap between the first surface 7011 of the light source 701 and the heat dissipation unit 702 is narrowed or can be deemed to disappear, as shown in FIG. 8, thereby allowing good thermal interaction between the heat dissipation unit 702 and the light source 701 so as to dissipate the heat generated by the light source 701 more effectively and control the light source 701 to the thermal stable temperature.

The preset temperature may be set lower than the thermal stable temperature of the light source 701 so as to ensure the gap is narrowed or can be deemed to disappear before the light source 701 reaches the thermal stable temperature. The closer the preset temperature is set to the thermal stable temperature of the light source 701, the shorter the thermal stable time needed for the light source 701 is.

To facilitate thermal transfer between the light source 701 and the heat dissipation unit 702 after the gap between the first surface 7011 of the light source 701 and the heat dissipation unit 702 is narrowed or can be deemed to disappear, advantageously the illumination apparatus 70 may further comprise a thermal interface material arranged between the first surface 7011 of the light source 701 and the heat dissipation unit 702. The configuration/material of the thermal interface material may be same as that of FIG. 1 or FIG. 4, and will not be described here for the purpose of simplicity.

Advantageously, the illumination apparatus 70 may further comprise an upper cover 704, which is mounted on a second surface 7012, i.e., a light-emitting surface opposite to the first surface 7011 of the light source 701, to at least partly enclose the phosphor-coated blue LED array and the red LED array. The configuration of the upper cover 704 may be the same as the upper cover 104 of FIG. 1 or the upper cover 404 of FIG. 4, and will not be described here for the purpose of simplicity.

The invention further provides a method of assembling an illumination apparatus. The illumination apparatus comprises a light source and a heat sink, wherein the light source comprises a plurality of LED arrays, and at least two of the plurality of LED arrays have different lumen degradations as a function of junction temperature.

The method comprises the step of: mounting the heat dissipation unit on a first surface of the light source in such a way that there is a gap between the first surface and the heat dissipation unit when the light source is not in operation, and the gap is narrowed or can be deemed to disappear when the light source reaches a preset temperature so that the heat dissipation efficiency of the heat dissipation unit is improved.

Advantageously, the method may further comprise the steps of: mounting an upper cover on a second surface opposite to the first surface of the light source, and placing a thermal deformation material between the upper cover and the second surface, wherein the thermal deformation material is configured to expand, thereby pressing the light source towards the heat dissipation unit so as to make the gap narrow or deemed to disappear when the light source reaches the preset temperature.

Advantageously, the method may further comprise the step of: placing a thermal deformation material between the first surface and the heat dissipation unit to form the gap therebetween when the light source is not in operation, wherein the thermal deformation material is configured to deform so as to make the gap narrow or deemed to disappear when the light source reaches the preset temperature.

Advantageously, the method may further comprise the step of: placing a thermal interface material between the first surface and the heat dissipation unit to facilitate thermal transfer between the light source and the heat dissipation unit.

It should be noted that the above described embodiments are given for describing rather than limiting the invention, and it is to be understood that modifications and variations may be resorted to without departing from the spirit and scope of the invention as those skilled in the art readily understand. Such modifications and variations are considered to be within the scope of the invention and the appended claims. The protective scope of the invention is defined by the accompanying claims. In addition, any of the reference numerals in the claims should not be interpreted as a limitation to the claims. Use of the verb "comprise" and its conjugations does not exclude the presence of elements or steps other than those stated in a claim. The indefinite article "a" or "an" preceding an element or step does not exclude the presence of a plurality of such elements or steps.

What is claimed is:

1. An illumination apparatus, comprising:

a light source comprising a plurality of LED arrays, wherein at least two of the plurality of LED arrays have different lumen degradations as a function of junction temperature of the respective LED arrays;

a heat dissipation unit configured for dissipating heat generated by the light source; wherein the heat dissipation unit is mounted on a first surface of the light source in such a way that there is a gap between the first surface and the heat dissipation unit when the light source is not in operation, and the gap is at least narrowed when the light source reaches a preset temperature, so that the heat dissipation efficiency of the heat dissipation unit is improved.

2. An illumination apparatus according to claim 1, further comprising a thermal deformation material configured to deform so as to cause the gap to narrow when the light source reaches the preset temperature.

3. An illumination apparatus according to claim 2, further comprising an upper cover mounted on a second surface opposite to the first surface of the light source and configured to at least partly enclose the plurality of LED arrays; wherein the thermal deformation material is arranged between the upper cover and the second surface, and configured to expand to press the light source towards the heat dissipation unit when the light source reaches the preset temperature.

4. An illumination apparatus according to claim 2, wherein the thermal deformation material is arranged between the first surface and the heat dissipation unit to form the gap therebetween when the light source is not in operation, and configured to deform when the light source reaches the preset temperature.

5. An illumination apparatus according to claim 1, further comprising:

a thermal interface material arranged between the first surface and the heat dissipation unit, and configured to facilitate thermal transfer between the light source and the heat dissipation unit.

6. An illumination apparatus according to claim 5, wherein the thermal interface material comprises any one of the following:

thermal pad;

thermal grease;

thermal paste.

7. An illumination apparatus according to claim 2, wherein the thermal deformation material comprises any one of the following:

bimetal;

shape memory alloy;

silicone rubber spacer.

8. An illumination apparatus according to claim 3, wherein the upper cover comprises an optical component configured to distribute light generated by the light source.

9. An illumination apparatus according to claim 1, further comprising a PCB board, wherein the plurality of LED arrays are mounted on the PCB board.

10. An illumination apparatus according to claim 1, wherein the preset temperature is lower than the thermal stable temperature of the light source.

11. An illumination apparatus according to claim 1, wherein the plurality of LED arrays comprises a phosphor-coated blue LED array and a red LED array.

12. A method of assembling an illumination apparatus including a light source and a heat dissipation unit, wherein the light source comprises a plurality of LED arrays and at least two of the plurality of LED arrays have different lumen degradations as a function of junction temperature, the method comprising:

mounting the heat dissipation unit on a first surface of the light source in such a way that there is a gap between the first surface and the heat dissipation unit when the light source is not in operation, and causing the gap to narrow or disappear when the light source reaches a preset temperature, thereby improving the heat dissipation efficiency of the heat dissipation unit.

13. A method according to claim 12, further comprising:

mounting an upper cover on a second surface opposite to the first surface of the light source;

placing a thermal deformation material between the upper cover and the second surface;

wherein the thermal deformation material is configured to expand to press the light source towards the heat dissipation unit when the light source reaches the preset temperature.

* * * * *